US011779136B2

(12) United States Patent
McAndrew

(10) Patent No.: US 11,779,136 B2
(45) Date of Patent: Oct. 10, 2023

(54) PROCESS FOR OPTIMISING THE POSITION OF REFRIGERATOR AIR GUIDES IN ORDER TO ACHIEVE INCREASED ENERGY EFFICIENCY OF THE REFRIGERATOR

(71) Applicant: Aerofoil Energy Limited, Cheshire (GB)

(72) Inventor: Paul McAndrew, Cheshire (GB)

(73) Assignee: Aerofoil Energy Limited, Cheshire (GB)

( * ) Notice: Subject to any disclaimer, the term of this patent is extended or adjusted under 35 U.S.C. 154(b) by 32 days.

(21) Appl. No.: 17/526,723

(22) Filed: Nov. 15, 2021

(65) Prior Publication Data

US 2022/0071411 A1 Mar. 10, 2022

Related U.S. Application Data

(63) Continuation of application No. PCT/GB2020/051182, filed on May 14, 2020.

(30) Foreign Application Priority Data

May 16, 2019 (GB) ..... 1906935

(51) Int. Cl.
*A47F 3/04* (2006.01)
*F25D 17/08* (2006.01)
*F25D 23/02* (2006.01)

(52) U.S. Cl.
CPC ..... *A47F 3/0447* (2013.01); *A47F 3/0469* (2013.01); *F25D 17/08* (2013.01);
(Continued)

(58) Field of Classification Search
CPC ..... F25D 17/08; F25D 23/023; F25D 2323/0021; F25D 2700/123; F25D 2700/121; A47F 3/0447; A47F 3/0478
See application file for complete search history.

(56) References Cited

U.S. PATENT DOCUMENTS 5,317,881 A * 6/1994 Colvin ..... A47F 3/0443 62/256
2002/0148240 A1* 10/2002 Lawrence ..... F25D 21/006 62/80

(Continued)

FOREIGN PATENT DOCUMENTS

CN 208025920 U 10/2018
DE 102010013977 A1 10/2011

(Continued)

OTHER PUBLICATIONS

International Search Report and Written Opinion for International Application No. PCT/GB2020/051182 dated Aug. 14, 2020, 10 pages.

(Continued)

*Primary Examiner* — David J Teitelbaum
(74) *Attorney, Agent, or Firm* — Cooley LLP

(57) ABSTRACT

The provides disclosure describes a method for configuring an open display refrigerator, the method comprises: a measuring an initial temperature difference between the warmest temperature recorded by an array of temperature sensors and the coldest temperature recorded by the array of temperature sensors; coupling an air guide to at least one shelf; adjusting the distance between the air guide and the edge of the shelf for the at least one shelf; measuring a final temperature difference associated with the distance, the final temperature difference being the temperature difference between the warmest temperature recorded by the array of temperature sensors and the coldest temperature recorded by the array of temperatures sensors after coupling an air guide to the at least one shelf; selecting a distance from the plurality of distances that gives rise to at least a threshold temperature difference, or selecting the distance from the plurality of distances wherein the difference between the initial tem- (Continued)

perature difference and the associated final temperature difference is greatest.

10 Claims, 4 Drawing Sheets

(52) U.S. Cl.
CPC .... *F25D 23/023* (2013.01); *F25D 2323/0021* (2013.01); *F25D 2700/123* (2013.01)

(56) References Cited

U.S. PATENT DOCUMENTS

2015/0297000 A1* 10/2015 Gomes ..... A47F 3/0447 62/255
2016/0302591 A1 10/2016 McAndrew
2017/0231403 A1* 8/2017 Eget ..... A47F 3/0447 454/192

FOREIGN PATENT DOCUMENTS

| | | | | | |
|---|---|---|---|---|---|
| EP | 0403459 | A1 | | 12/1990 | |
| EP | 2574871 | A2 | | 4/2013 | |
| EP | 3213960 | A1 | | 9/2017 | |
| GB | 2555227 | A | * | 4/2018 | ..... A47F 3/0447 |
| JP | S51150569 | U | | 12/1976 | |
| JP | S5478969 | U | | 6/1979 | |
| WO | WO-2020229832 | A1 | | 11/2020 | |

OTHER PUBLICATIONS

Search Report, dated Nov. 6, 2019, for United Kingdom Application No. 1906935.0 (1 page).

* cited by examiner

PROCESS FOR OPTIMISING THE POSITION OF REFRIGERATOR AIR GUIDES IN ORDER TO ACHIEVE INCREASED ENERGY EFFICIENCY OF THE REFRIGERATOR

CROSS REFERENCE TO RELATED APPLICATIONS

This application is a continuation of International Patent Application No. PCT/GB2020/051182, entitled "Refrigerators" and filed on May 14, 2020, the entire contents of which are hereby incorporated by reference. International Patent Application No. PCT/GB2020/051182 claims priority to G.B. Application No. 1906935.0, entitled "Process for Optimising the Position of Refrigerator Air Guides in Order to Achieve Increased Energy Efficiency of the Refrigerator" and filed on May 16, 2019.

FIELD

This invention relates to methods of modifying open display refrigerators.

BACKGROUND

Open display refrigerators are commonly used in retail environments, such as supermarkets, to store and display products, such as meat and dairy products, which must be kept at lower than ambient temperatures. The open front of such a refrigerator makes it easy for customers to view the products being displayed and to retrieve products they wish to purchase from the refrigerator.

This type of refrigerator has an air curtain, which is established by blowing cold air across the front of the refrigerator. The air curtain issues from an air outlet at the top of the refrigerator towards an air inlet at the bottom of the refrigerator. The air inlet recovers air from the air curtain and recirculates it to the air outlet via a cooling heat exchanger and fan.

Generally, it is intended that the air curtain follows a broadly linear path from the air outlet to the air inlet thereby preventing cold air in the refrigerator from mixing with warm air exterior to the refrigerator. However, such an air curtain is rather inefficient, in particular because the air curtain tends to spill out from the bottom of the refrigerator and warm air from the exterior becomes entrained into the air curtain. To ameliorate this problem of inefficiency, air guides fixed on the front edge of shelves in the refrigerator can be used to help constrain the air curtain within a desired region.

To work effectively, the air guides need to be in reasonably good alignment with an outer edge of the air curtain. In some refrigerator designs, for example those having a deep air outlet, this can result in there being a large gap between the front edge of the shelves and the air guides. If the air guide protrudes too far from the edge of the shelf, this can prevent shoppers from viewing produce on a shelf sited below the air guide.

SUMMARY

In accordance with a first aspect of the invention, there is provided a method for configuring an open display refrigerator, wherein the open display refrigerator comprises a refrigerated storage space and at least one shelf in the interior of the open display refrigerator, air in the refrigerated storage space being separated from air exterior to the open display refrigerator by an air curtain established by a fan which blows air towards an air outlet, air in the air curtain being recovered by an air inlet which recirculates the air from the air curtain into an air duct coupled to the air outlet and wherein the method comprises: a) providing an array of temperature sensors within the interior of the open display refrigerator; b) measuring an initial temperature difference between the warmest temperature recorded by the array of temperature sensors and the coldest temperature recorded by the array of temperature sensors; c) coupling an air guide to an edge of the at least one shelf distal to a rear wall of the refrigerated storage space at a start point; d) adjusting the distance between the air guide and the edge of the shelf for the at least one shelf; e) measuring a final temperature difference associated with the distance, the final temperature difference being the temperature difference between the warmest temperature recorded by the array of temperature sensors and the coldest temperature recorded by the array of temperatures sensors after coupling an air guide to the at least one shelf; f) repeating steps (d) and (e) for a plurality of distances at discrete intervals; g) selecting a distance from the plurality of distances that gives rise to at least a threshold temperature difference, or selecting the distance from the plurality of distances wherein the difference between the initial temperature difference and the associated final temperature difference is greatest.

The temperature difference may be measured by placing numerous jelly-bricks (examples of jelly-bricks known in the art are Tylose packs or M-Packs) on the shelves of the refrigerator. The jelly-bricks are used to emulate the items in a refrigerator, in that the refrigerator needs to work to cool down the jelly-bricks and to maintain them at a lower than ambient temperature. Each jelly-brick may have its own temperature sensor or probe, which together may make up the array of temperature sensors or probes. In this way, the temperature at different points of the refrigerator can be tracked. Alternatively, a sub-set of the jelly-bricks may have their own temperature sensor or probe. This sub-set of jelly-bricks with temperature sensors may be located at regular intervals on all of the shelves, or there may be clusters of probes near different features of the refrigerator, such as the air outlet, air inlet or above a cooling unit or heat exchanger of the refrigerator (as ice is more likely to form above the cooling unit or heat exchanger if the refrigerator is set up sub-optimally). Other variables, such as humidity may also be measured by additional probes associated with each jelly-brick or a sub-set of the jelly-bricks. As the location of the warmest jelly-brick and the location of the coolest jelly-brick may change with the addition of the air guide and/or adjustments made to the air guide, the difference between the temperature of the warmest jelly-brick and the temperature of the coolest jelly-brick is measured, so that the overall effect on the refrigerator temperature can be monitored. In some embodiments, stand-alone thermometers may be used instead of an array of temperature probes and the temperatures may be collected individually from different locations in the refrigerator. Alternatively, a user with an infrared thermometer may measure the temperatures of the visible jelly-bricks and record the location and temperatures of the hottest and the coldest jelly-bricks.

The threshold temperature difference may be any meaningful temperature difference and will depend on the size and the geometry of the refrigerator. Meaningful temperature differences may be at any number, at increments of 0.1° C. or in the range of 0.100-10° C. In practice, it is likely that values that are multiples of 0.5° C. or 1° C. would be chosen. The temperature difference may be optimised by selecting a distance between the air guide and the edge of the shelf that give the biggest reduction in temperature difference.

The bottom surface (the "bottom shelf") of the interior of a refrigerator may be used for displaying produce. However, as such a surface is usually proximate the air inlet, no air guide is usually attached to the bottom shelf. Where shelves are mentioned, it should be assumed that the shelf is not the "bottom shelf", unless explicitly referred to.

For refrigerators comprising more than one shelf, an air guide may be coupled to each shelf in the refrigerator. In this case, all of the air guides may be sited at the same distance away from the shelf. In this scenario, all of the air guides may be moved by the same distance in step (d). Alternatively, each air guide may be sited at a different distance away from the respective shelf. In this alternative scenario, the method may be run on a shelf-by-shelf basis, finding a threshold or the greatest temperature distance for a first shelf and a first air guide, and then performing the method again for a second shelf and a second air guide and so forth until the air guides have been positioned for all of the shelves that it is intended to have an air guide coupled to.

In some embodiments, a maximum distance between the air guide and the edge of the shelf is determined, where the maximum distance is the distance beyond which an average user is obstructed by the air guide from viewing an item placed on a shelf sited below the shelf to which the air guide is coupled.

An average user is determined by the assumed average height of users of the refrigerator, for example shoppers in a grocery store. Such an average height may be determined by taking a survey of shoppers in a grocery store. As an example, an average user may be assumed to be 1.75 m tall and their eyes may be assumed to be at a height of 1.6 m from the ground. On average, it can be assumed that a shopper stands 0.5 m away from a shelf when looking at an item. This distance may change, for example, if a grocery store has narrow aisles. When looking at a shelf (including the bottom shelf) that is below eye level, the view of a user is likely to be obstructed by an air guide that protrudes excessively from a shelf that is higher up in the refrigerated interior than the shelf that a user is looking at. Different retailers may have different tolerances of the percentage of view of a user that can be obstructed. For example, a retailer selling luxury items may wish to accept a lower energy efficiency in return for less obstruction of items on lower shelves. A retailer selling broadly identical products may wish to maximise their energy efficiency in return for more obstruction of items on lower shelves. For example, an air guide that protrudes further than 10 mm from a first shelf can obstruct up to 20% of the view of a user of a second shelf sited below the first shelf. The maximum distance may, therefore, be set at 10 mm for a refrigerator in the store of a retailer who is happy to accept an obstruction of up to 20% of the view of a user of a second shelf sited below the first shelf. This may differ from the optimum distance away from the shelf for energy efficiency, which may, for example, be 20 mm. By limiting the maximum distance between the edge of the shelf and the air guide, a balance between energy efficiency and allowing a user to view produce on a lower shelf is reached.

A technical advantage of this method is that it helps to avoid the view of a user from being impeded, whilst still allowing improved energy efficiency associated with installing air guides, and preferably, aerofoils on one or more shelves of a refrigerator.

In some embodiments, the array of temperature sensors are provided within the refrigerated storage space. Other locations are discussed below. A technical advantage of providing the temperature sensors within the refrigerated storage space is that temperature difference experienced by items that will be stored in the refrigerator can be monitored. For example, some meat or dairy products may need to be stored below a certain temperature, by measuring different spots within the refrigerated storage space, it is possible to predict whether these items can be stored below that temperature at any point in the refrigerator or whether certain shelves should be avoided.

In some embodiments, at least one temperature sensor of the array of temperature sensors is provided proximate the air inlet. In some embodiments, at least one temperature sensor of the array of temperatures sensors is provided proximate the air outlet. A technical advantage of providing a temperature sensor proximate the air inlet and the air outlet is that it allows the temperature difference of the air curtain to be monitored as it flows from the air outlet to the air inlet.

Additionally, at least one temperature sensor of the array of temperature sensors may be provided in the air duct. The temperature sensor(s) may be located before and/or after the heat exchanger. A technical advantage of providing a temperature sensor in the air duct is that it allows the amount of cooling imparted by the heat exchanger to be measured.

In some embodiments, step (f) comprises moving the air guide 10 mm in a first direction away from the edge of the at least one shelf from the start point to a first point for a first repetition and moving the air guide 10 mm in the first direction from the first point to a second point for a second repetition.

In some embodiments, step (f) further comprises moving the air guide 10 mm in a second direction opposite the first direction from the start point.

In some embodiments, the distance between the air guide and the edge of the shelf is the minimum distance between a surface of the air guide that faces the edge of the shelf and the edge of the shelf. The minimum distance is the shortest physical distance in a straight line between the air guide and the edge of the shelf. When the air guide is an aerofoil, the air guide will comprise a curved surface, hence the minimum distance is the distance measured between the edge of the shelf and the point at which the curve protrudes the most.

In some embodiments, step (f) comprises measuring the distance at regular intervals.

In some embodiments, the air guide may be an aerofoil. An aerofoil works by being situated in the airflow of the air curtain of the refrigerator, with a portion of the air flow flowing either side of the aerofoil. The shape of the aerofoil causes a change in the direction of flow of the air curtain as it flows over the aerofoil. An aerofoil comprises a pressure surface and a suction surface.

BRIEF DESCRIPTION OF THE DRAWINGS

Embodiments of the invention will now be described with reference to the accompanying drawings, in which.

DETAILED DESCRIPTION

Figure 1:
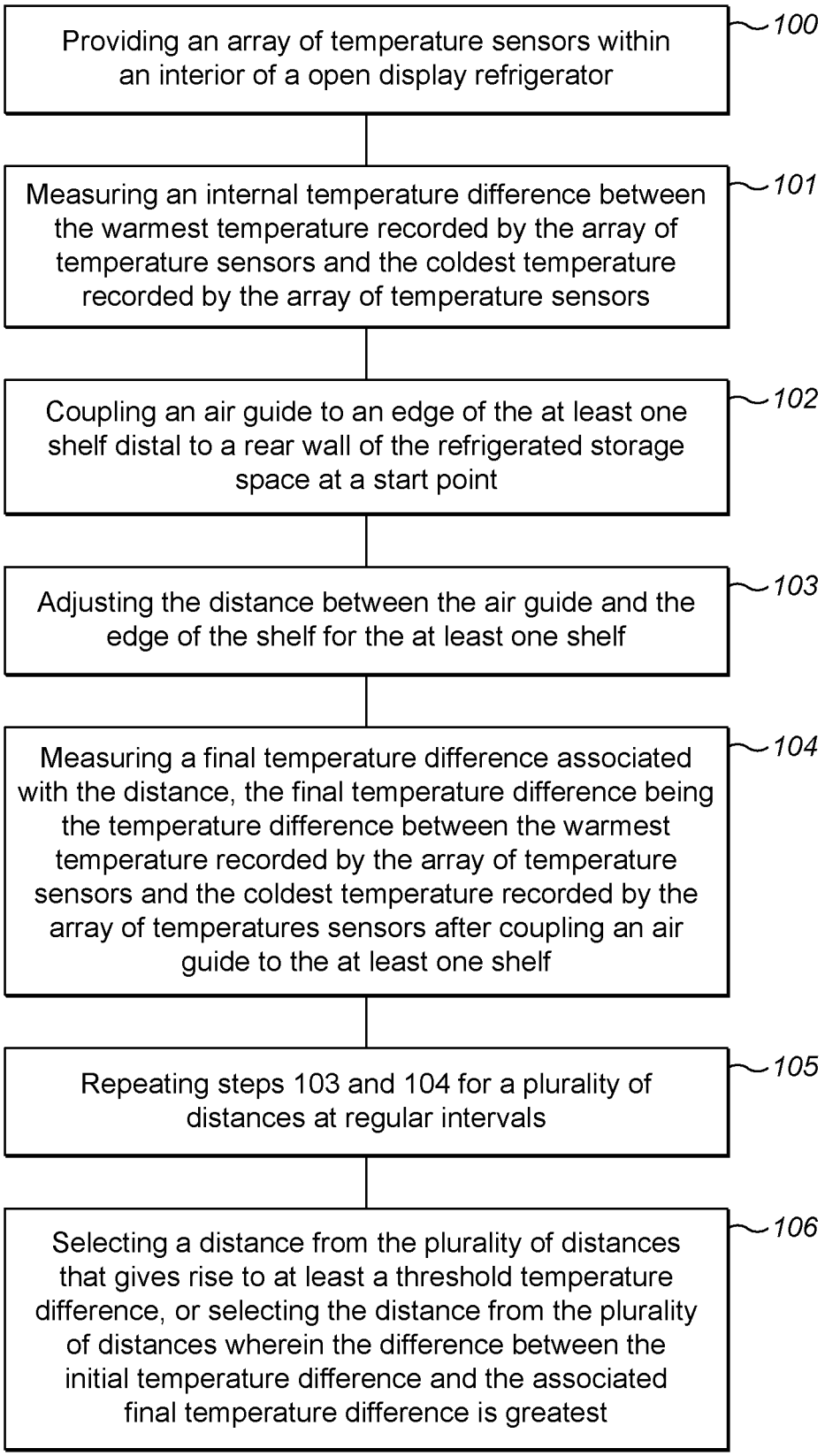
FIG. 1 shows method steps for configuring an open display refrigerator.

FIG. 1 shows a flow chart for a method of configuring an open display refrigerator, wherein the open display refrigerator comprises a refrigerated storage space and at least one shelf in the interior of the open display refrigerator, air in the refrigerated storage space being separated from air exterior to the open display refrigerator by an air curtain established by a fan which blows air towards an air outlet, air in the air curtain being recovered by an air inlet which recirculates the air from the air curtain into an air duct coupled to the air outlet and wherein the method comprises: providing an array of temperature sensors within the interior of the open display refrigerator 100; measuring an initial temperature difference between the warmest temperature recorded by the array of temperature sensors and the coldest temperature recorded by the array of temperature sensors 101; coupling an air guide to an edge of the at least one shelf distal to a rear wall of the refrigerated storage space at a start point 102; adjusting the distance between the air guide and the edge of the shelf for the at least one shelf 103; measuring a final temperature difference associated with the distance, the final temperature difference being the temperature difference between the warmest temperature recorded by the array of temperature sensors and the coldest temperature recorded by the array of temperatures sensors after coupling an air guide to the at least one shelf 104; repeating steps 103 and 104 for a plurality of distances at regular intervals 105; selecting a distance from the plurality of distances that gives rise to at least a threshold temperature difference, or selecting the distance from the plurality of distances wherein the difference between the initial temperature difference and the associated final temperature difference is greatest 106.

A threshold energy difference might be, for example, a reduction of 1° C. between the warmest and coldest recorded temperatures. Other characteristics may be measured, such as energy consumed by the refrigerator with the air guides at different distances. In this case, the method may be changed, so that an initial energy consumption over a set period is measured in step 101. The energy consumed by the refrigerator over a set period is may be measured with the air guide at different distances in step 104. The distance selected in step 106 may be based on a threshold energy consumption or the greatest difference in energy consumption. The set period may be, for example, 24 hours or any amount of time that allows the temperature in the refrigerator to stabilise. The energy consumption may be measured in kWh/24 hr.

In some embodiments, the array of temperature sensors are provided within the refrigerated storage space. In some embodiments, a temperature sensor of the array of temperature sensors is provided proximate the air inlet and/or the air outlet. Additionally, at least one temperature sensor of the array of temperature sensors may be provided in the air duct. The temperature sensor(s) may be located before and/or after the heat exchanger.

In some embodiments, the method may include steps that comprise measuring the temperature by placing numerous jelly-bricks (examples of jelly-bricks known in the art are Tylose packs or M-Packs) on the shelves of the refrigerator, wherein each jelly-brick has its own temperature sensor or probe, which together make up the array of temperature sensors or probes, so that the temperature at different points of the refrigerator can be tracked. As the location of the warmest jelly-brick and the location of the coolest jelly-brick may change with adjustments made to the air guide, the difference between the warmest temperature of the jelly-brick and the coolest temperature of the jelly-brick may be measured as opposed to measuring the temperature of the same jelly-bricks before and after adjusting the air guide.

Figure 2:
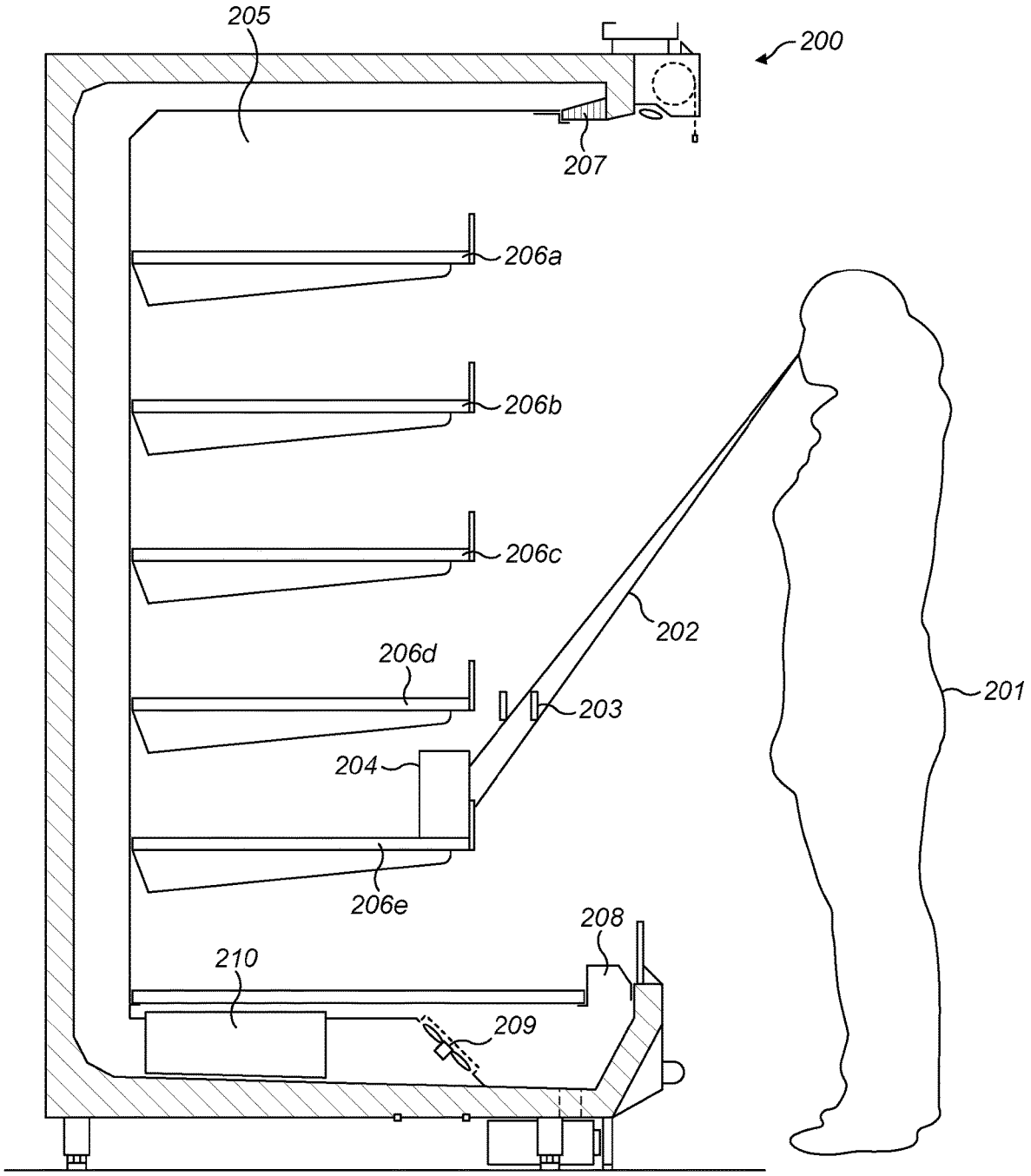
FIG. 2 shows an average user viewing an item on the shelf of an open display refrigerator.

FIG. 2 shows a cross section through an open display refrigerator 200. The refrigerator 200 has a storage space 205 that is maintained at a lower than ambient temperature. Within the storage space there are five storage shelves 206*a-e*. Different embodiments may have one, two, three, four, six or any other reasonable number of storage shelves depending on the size of the refrigerator. The storage shelves may be flat, may be at an angle or may be a mix of angled and flat shelves. The refrigerator 200 establishes an air curtain (not shown) by a fan (not shown) which blows cold air towards an air outlet 207, out of the air outlet 207 and towards and air inlet 208. Air inlet 208 recovers air from the air curtain and a fan 209 within the refrigerator 200 recirculates the air to the air outlet 207. An air guide 203, attached to the shelf 206*d* helps to maintain the path of the air curtain. Air guides may optionally be attached to one or more of the other shelves 206*a-c*, 206*e*. The air guide(s) may be in the form of an aerofoil, which works by being situated in the airflow of the air curtain of the refrigerator 200, with a portion of the air flow flowing either side of the aerofoil. The shape of the aerofoil causes a change in the direction of flow of the air curtain as it flows over the aerofoil. An aerofoil comprises a pressure surface and a suction surface. A cooling unit or heat exchanger 210 within the refrigerator 200 maintains the recirculated air (and hence the air blown through the air outlet 207 to form the air curtain) at a desired temperature. The desired temperature is chosen to be lower than ambient and acts to prevent cold air in the storage space 205 from mixing with warm air exterior to the refrigerator. An average user 201 is shown standing in front of the refrigerator 200, looking at an item 204 on a lower shelf 206*e*. A portion of the field of view of the user 201 that is obstructed by the air guide 203 is shown by the area 202. As can be seen in this example, the air guide 203 impedes the user's view of the item 204, as it protrudes out too far from the edge of the shelf 206*d*. The method of this application aims to avoid the view of a user from being impeded, whilst still allowing improved energy efficiency associated with installing aerofoils on one or more shelves of a refrigerator.

Figure 3:
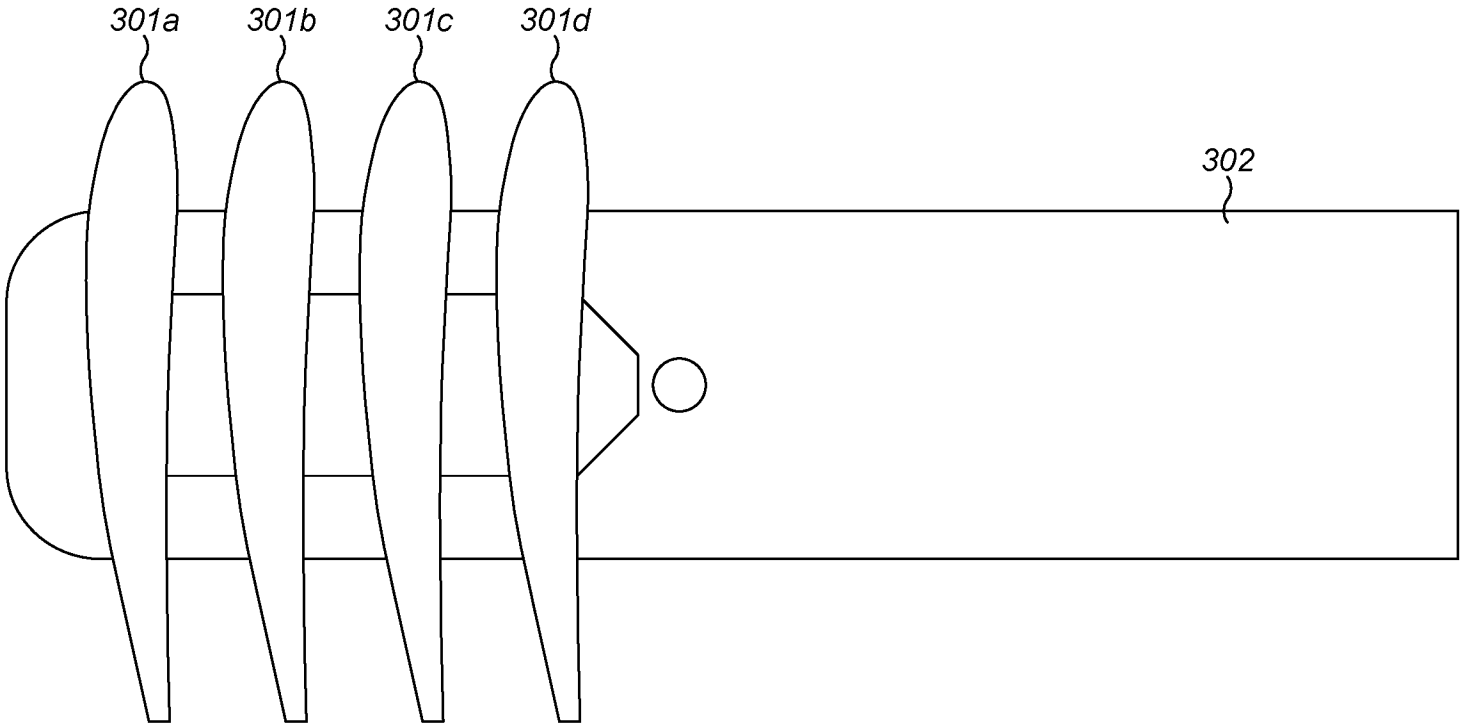
FIG. 3 shows a bracket for attaching an air guide to a shelf and an air guide attached to the air guide in different positions.

FIG. 3 shows a bracket 302 for attaching an air guide to the shelf of a refrigerator (for example, the refrigerator 200 shown in FIG. 2). The bracket allows the air guide 301 to be moved between a number of discrete positions 301*a-d*. For example, 301c might represent a neutral position for an air guide, 301*d* might represent moving the air guide from a neutral position closer to the shelf, for example by a distance of 10 mm (or −10 mm), 301*b* might represent moving the air guide from a neutral position away from the shelf, for example by a distance of 10 mm (or +10 mm) and 301*a* might represent moving the air guide even further away from the shelf, for example by a distance of 20 mm (or +20 mm). Other discrete intervals are contemplated, for example 5 mm, 7 mm or 15 mm. Although the same interval is used in this explanation, a mix of intervals may be used, for example −4 mm, +6 mm and +9 mm. The positions 301*a*-301*d* may represent the regular intervals of step 105 in FIG. 1.

Figure 4A:
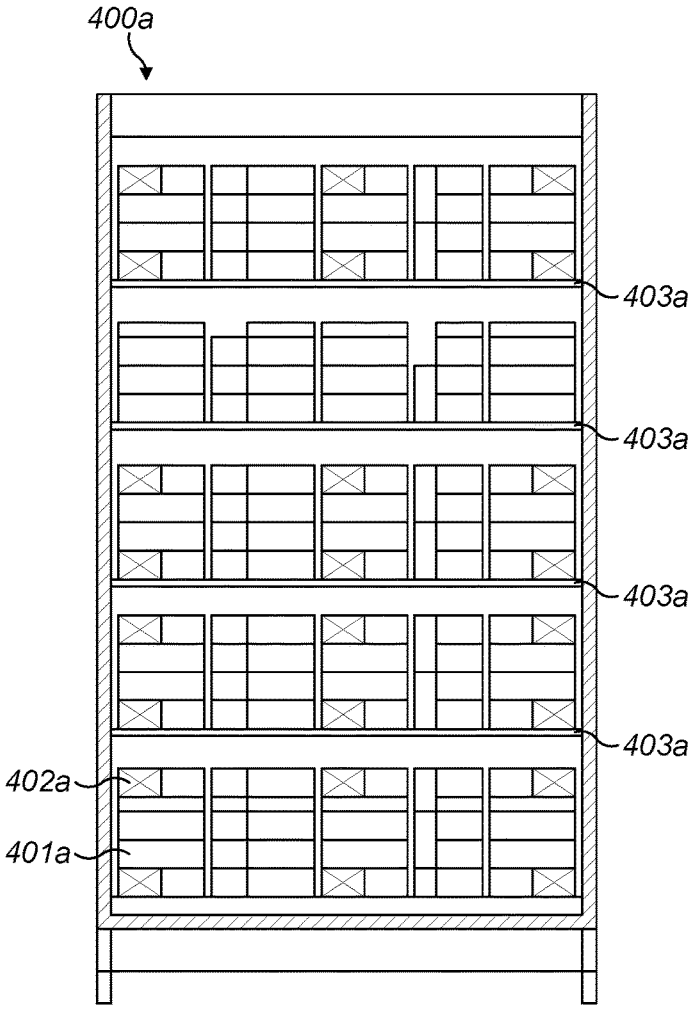
FIGS. 4*a*-4*c* show a longitudinal section, a cross section and a plan view respectively of jelly bricks in an open display refrigerator.
Figure 4B:
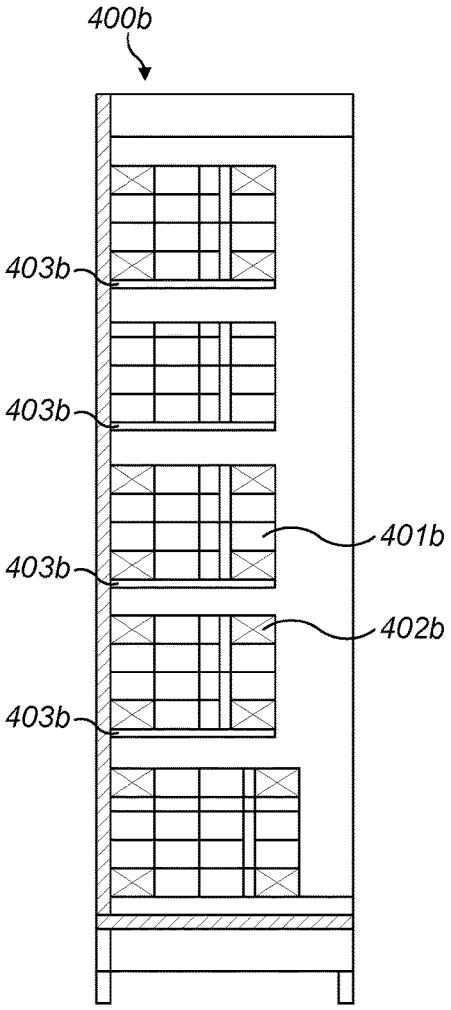
Figure 4C:
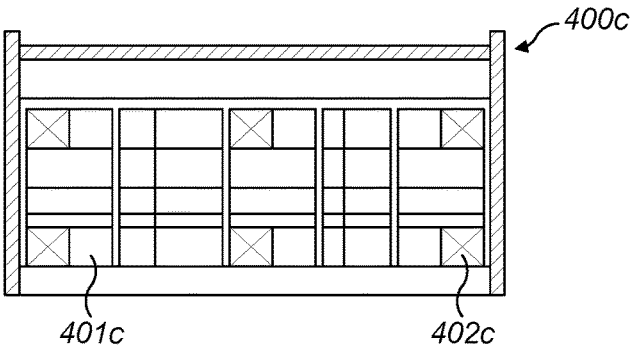

FIGS. 4*a*-4*c* show a longitudinal section, a cross section and a plan view of jelly bricks in an open display refrigerator. This is an example of how the jelly bricks and the temperature sensors used for measuring the temperature in the refrigerated storage space may be arranged. As mentioned previously, numerous jelly-bricks (the jelly-bricks are represented by rectangles on the shelves 403*a, b* of the refrigerator 400*a-c* and are indicated by 401*a-c*) may be placed on the shelves 403*a, b* of a refrigerator 400*a-c*, where the jelly-bricks 401*a-c* emulate items placed in the refrigerator 400*a-c*. The jelly-bricks further comprising an "x" (indicated, for example, by 402*a-c*) are where the jelly-bricks also comprise a temperature probe for measuring the temperature difference as indicated in steps 101 and 104 of FIG. 1.

By repeating steps 103 and 104 of the method, the user will obtain a number of final temperature differences associated with the selected distances between the air guide and the edge of the shelf. These temperature differences can be analysed to see if any of the temperature differences meet a threshold temperature difference or to see which of the temperature differences is the greatest. The user can then select the distance between the air guide and the edge of the shelf that best meets their needs or can repeat steps 103 and 104 again in order to collect more data points. Once the distance between the air guide and the edge of the shelf associated with the threshold temperature distance or the greatest temperature difference is selected, this distance can then be used to configure the refrigerator. The refrigerator can configured by setting the distance between the one or more air guides and the one or more shelves at the selected distance.

The invention claimed is:

1. A method for configuring an open display refrigerator, wherein air in an interior of the open display refrigerator being separated from air exterior to the open display refrigerator by an air curtain established by a fan which blows air towards an air outlet, air in the air curtain being recovered by an air inlet which recirculates the air from the air curtain into an air duct coupled to the air outlet and wherein the method comprises:

measuring an initial temperature difference between a warmest temperature and a coldest temperature recorded by an array of temperature sensors within the interior of the open display refrigerator;

coupling an air guide to an edge of a shelf within the interior of the open display refrigerator after measuring the initial temperature;

adjusting the air guide such that the air guide is spaced apart from the edge of the shelf by each of a plurality of distances;

measuring a plurality of final temperature differences, each final temperature difference from the plurality of final temperature difference measured with the air guide spaced apart from the edge of the shelf by a different distance from the plurality of distances, each final temperature difference from the plurality of final temperature differences being a difference in between a warmest temperature and a coldest temperature recorded by the array of temperature sensors; and selecting a distance from the plurality of distances based on that distance (1) being associated with a final temperature difference that is greater than a threshold temperature difference and/or being associated with a largest final temperature difference from the plurality of final temperature differences.

2. The method of claim 1, wherein the shelf is a first shelf, the method further comprising:

determining a maximum distance between the air guide and the edge of the shelf, the maximum distance being a distance beyond which the air guide obstructs vision of an average user from viewing an item placed on a second shelf sited below the first shelf.

3. The method of claim 1, wherein the array of temperature sensors are disposed within a refrigerated storage space of the open display refrigerator.

4. The method of claim 3, wherein at least one temperature sensor of the array of temperature sensors is configured to measure a temperature at the air inlet.

5. The method of claim 3, wherein at least one temperature sensor of the array of temperatures sensors is configured to measure temperature at the air outlet.

6. The method of claim 1, wherein the air guide is adjusted at 10 mm increments.

7. The method of claim 6, wherein:

adjusting the air guide includes moving the air guide in a first direction such that the air guide is spaced apart from the edge of the shelf by a first distance from the plurality of distances and moving the air guide in a second direction opposite the first direction such that the air guide is spaced apart from the edge of the shelf by a second distance from the plurality of distances; and measuring the plurality of final temperature differences includes measuring a first final temperature difference from the plurality of final temperature differences when the air guide is spaced apart from the edge of the shelf by the first distance and measuring a second final temperature difference from the plurality of final temperature differences when the air guide is spaced apart from the edge of the shelf by the second distance.

8. The method of claim 1, wherein the air guide is coupled to the edge of the shelf at a minimum distance from the plurality of distances.

9. The method of claim 1, further comprising measuring each distance from the plurality of distances while adjusting the air guide.

10. The method of claim 1, wherein the air guide is an aerofoil.

* * * * *